United States Patent [19]

Saito et al.

[11] Patent Number: 4,797,593

[45] Date of Patent: Jan. 10, 1989

[54] CATHODE FOR ELECTRON TUBE

[75] Inventors: Masato Saito; Keiji Fukuyama; Masako Ishida; Keiji Watanabe, all of Kamakura; Toyokazu Kamata; Kinjiro Sano, both of Nagaokakyo, all of Japan

[73] Assignee: Mitsubishi Denki Kabushiki Kaisha, Tokyo, Japan

[21] Appl. No.: 886,777

[22] Filed: Jul. 17, 1986

[30] Foreign Application Priority Data

| | | | |
|---|---|---|---|
| Jul. 19, 1985 | [JP] | Japan | 60-160851 |
| Oct. 14, 1985 | [JP] | Japan | 60-229304 |
| Oct. 14, 1985 | [JP] | Japan | 60-229302 |
| Oct. 14, 1985 | [JP] | Japan | 60-229303 |
| Oct. 15, 1985 | [JP] | Japan | 60-231905 |
| Oct. 15, 1985 | [JP] | Japan | 60-231906 |
| Oct. 15, 1985 | [JP] | Japan | 60-231904 |
| Jan. 18, 1986 | [JP] | Japan | 61-8365 |
| Jan. 18, 1986 | [JP] | Japan | 61-6366 |
| Feb. 19, 1986 | [JP] | Japan | 61-35670 |
| Feb. 19, 1986 | [JP] | Japan | 61-35671 |
| Feb. 25, 1986 | [JP] | Japan | 61-41050 |

[51] Int. Cl.[4] ..... H01J 1/02

[52] U.S. Cl. ..... 313/346 R; 313/355; 252/521

[58] Field of Search ..... 313/346 R, 346 DC, 355; 252/521, 520, 519, 513, 512

[56] References Cited

U.S. PATENT DOCUMENTS

| | | | |
|---|---|---|---|
| 1,794,298 | 2/1931 | Just | 313/346 X |
| 3,358,178 | 12/1967 | Figner et al. | 313/346 X |
| 3,719,856 | 3/1973 | Koppius | 313/346 DC |
| 3,922,428 | 11/1975 | Cronin | 313/346 X |
| 4,007,393 | 2/1977 | van Stratum et al. | 313/346 R |
| 4,081,713 | 3/1973 | Misumi | 313/346 R |
| 4,273,683 | 6/1981 | Kawamura | 252/513 |
| 4,350,920 | 11/1982 | Bertens | 313/346 R |
| 4,446,404 | 5/1984 | Kumada et al. | 313/346 R |
| 4,594,220 | 6/1986 | Hasker et al. | 252/521 X |
| 4,625,142 | 12/1986 | Van Esponk et al. | 313/346 DC |
| 4,636,681 | 1/1987 | Misumi | 313/346 R |

FOREIGN PATENT DOCUMENTS

| | | | |
|---|---|---|---|
| 477232 | 6/1922 | Fed. Rep. of Germany | 313/346 |
| 880181 | 5/1953 | Fed. Rep. of Germany | 313/346 |
| 976106 | 2/1963 | Fed. Rep. of Germany | 313/346 |
| 2626700 | 1/1977 | Fed. Rep. of Germany | 313/346 |
| 53-5011 | 1/1978 | Japan | 313/346 |
| 55-5661 | 2/1980 | Japan | 313/346 |
| 56-78066 | 6/1981 | Japan | 313/346 |
| 55-9828 | 1/1984 | Japan | 313/346 |
| 59-20941 | 2/1984 | Japan | 313/346 |
| 59-138033 | 8/1984 | Japan | 313/346 |
| 1592502 | 7/1981 | United Kingdom | 313/346 |

OTHER PUBLICATIONS

Haas et al., *Interatomic Auger Analysis of the Oxidation of Thin Barium Films,* Applications of Surface Science 16, North Holland Publishing Co. (1983) pp. 142–143, 148–149 and 156–162.

Yamamoto et al., *Electron Emission Properties and Surface Atom Behavior of Impregnated Cathodes with Rare Earth Oxide Mixed Matrix Base Metals,* Applications of Surface Science 20, Elsevier Science Publishers B.V. (1984) pp. 61–83.

R. O. Jenkins, A Review of Thermionic Cathodes, Vacuum, vol. 19, No. 8, Pergamon Press Limited, Great Britain, Sections 4.2 and 4.2.2.

"Activation and Early Life of a Pressed Barium Scandate Cathode", A. van Oostrom et al, Applications of Surface Science 2 (1979) 173–186.

*Primary Examiner*—Leo H. Boudreau
*Assistant Examiner*—Mark R. Powell
*Attorney, Agent, or Firm*—Lowe, Price, LeBlanc, Becker & Shur

[57] ABSTRACT

This invention is a cathode of an indirect heated type having improved electron emission characteristics.

A cathode for an electron tube in accordance with the present invention comprises: a base containing Ni as a major element; and a layer of an electron-emissive substance formed on the base, this layer comprising not only alkaline earth metal oxide as a principal component containing at least Ba, but also rare earth metal oxide of 0.1 to 20 wt. % or rare earth metal of 0.05 to 15 wt. %.

30 Claims, 10 Drawing Sheets

CATHODE FOR ELECTRON TUBE

CROSS REFERENCE TO RELATED APPLICATION

This application is related to copending application Ser. No. 864,566, filed on May 16, 1986.

BACKGROUND OF THE INVENTION

1. Field of the Invention

This invention relates to a cathode for an electron tube such as a cathode-ray tube of a TV set and particularly to an improvement in electron emission characteristics of the cathode.

2. Description of the Prior Art

FIG. 1 is a schematic sectional view illustrating a structure of a cathode for use in a cathode-ray tube (CRT) or an image pickup tube for a TV system. In a conventional cathode, a layer 2 of an electron-emissive substance made of an alkaline earth metal oxide containing at least BaO and further containing SrO and/or CaO is formed on a cylindrical base 1 made of Ni as a major element containing a small amount of a reducing element such as Si or Mg. A heater 3 is provided inside the base 1 and the electron-emissive layer 2 is heated by the heater 3 to emit thermal electrons.

Such a conventional cathode is manufactured by a process as described below. First, a suspension of a carbonate of an alkaline earth metal (Ba, Sr, Ca, etc.) is sprayed on the base 1 and the applied suspension is heated by the heater 3 in a dynamic vacuum. As a result, the alkaline earth metal carbonate is converted to an oxide. Then, the alkaline earth metal oxide is partially reduced at a high temperature of 900° to 1000° C. so that it is activated to have a semiconductive property, whereby an electron-emissive layer 2 made of an alkaline earth metal oxide is formed on the base 1.

In the above described activation process, a reducing element such as Si or Mg contained in the base 1 diffuses to move toward the interface between the alkaline earth metal oxide layer and the base 1, and then reacts with the alkaline earth metal oxide. For example, if the alkaline earth metal oxide is barium oxide (BaO), the reaction is expressed by the following formula (1) or (2).

$$BaO+\tfrac{1}{2}Si=Ba+\tfrac{1}{2}SiO_2 \quad (1)$$

$$BaO+Mg=Ba+MgO \quad (2)$$

Thus, the alkaline earth metal oxide layer 2 formed on the base 1 is partially reduced to become a semiconductor of an oxygen vacancy type. Consequently, an emission current of 0.5 to 0.8 A/cm$^2$ is obtained under the normal condition at an operation temperature of 700° to 800° C. However, in the cathode thus formed, a current density higher than 0.5 to 0.8 A/cm$^2$ can not be obtained for the following reasons. As a result of the partial reduction of the alkaline earth metal oxide, an intermediate layer of an oxide or a composite oxide such as $SiO_2$, MgO or $BaO.SiO_2$ is formed in the interface region between the base 1 and the alkaline earth metal layer 2 as is obvious from the formulas (1) and (2), so that the current is limited by a high resistance of the intermediate layer. In addition, it is believed that the intermediate layer serves to prevent the reducing element in the base 1 from diffusing into the electron-emissive layer 2 so that a sufficient amount of Ba may not be generated.

Incidentally, in a cathode disclosed in Japanese Patent Laying-Open Gazette No. 20941/1984, the thickness of the base 1 is made thin to obtain a rapid response rate in reaction in the cathode and for the purposes of preventing exhaustion of the reducing agent during the lifetime of the cathode and preventing lowering of the strength of the base 1, lanthanum is contained in a dispersed manner in the base 1 in the form of $LaNi_5$ and $La_2O_3$.

A cathode formed by pressing powder of mixture of W and $Ba_3Sc_4O_9$ is disclosed by A. van Oostrom et al. in *Applications of Surface Science* 2 (1979), pp. 173–186.

German Patent Laying-Open Gazette No. 2626700 discloses an electron-emissive substance for high-pressure discharge lamp where an alkaline earth metal oxide such as BaO is mixed with an oxide of W or Mo and a rare earth metal oxide.

British Patent No. 1592502 discloses an electron-emissive substance for a discharge lamp in which BeO and $Y_2O_3$ are added to $Ba_{2-x}Sr_xCaWO_6$(x=0–0.5).

SUMMARY OF THE INVENTION

A principal object of this invention is to provide an indirectly heated cathode in which electron emission characteristics have been improved.

A cathode according to an embodiment of this invention comprises: a base containing Ni as a major element; and a layer of an electron-emissive substance formed on the base, this layer containing not only an alkaline earth metal oxide as a principal component containing at least Ba but also a rare earth metal oxide of 0.1 to 20 wt. % or a rare earth metal of 0.05 to 15 wt. %.

A cathode according to another embodiment of this invention comprises: a base containing Ni as a major element; an intermediate layer of a rare earth metal oxide of 10 μm or less in thickness or a rare earth metal of 6 μm or less in thickness formed on the base; an electron-emissive layer of an alkaline earth metal oxide formed on the above stated intermediate layer and containing at least Ba.

A cathode according to a further embodiment of this invention comprises: a base containing not only Ni as a major element but also a rare earth metal of 0.01 to 0.5 wt. %; and an electron-emissive layer of an alkaline earth metal oxide containing at least Ba.

These objects and other objects, features, aspects and advantages of the present invention will become more apparent from the following detailed description of the present invention when taken in conjunction with the accoppanying drawings.

DESCRIPTION OF THE PREFERRED EMBODIMENTS

In a cathode according to an embodiment of the present invention, a layer 2 of an electron-emissive substance formed on a base 1 comprises an alkaline earth metal oxide as a principal component containing at least Ba and additionally containing Sr and/or Ca in certain circumstances. This layer 2 of the electron-emissive substance further contains a rare earth metal oxide of Sc or Y in 0.1 to 20 wt. %.

The above described cathode can be manufactured by the below described process. First, scandium oxide powder or yttrium oxide powder is mixed in a ternary carbonate containing Ba, Sr and Ca, by an amount corresponding to a desired wt. % (to be obtained after the above stated ternary carbonate has been all converted to oxide). Then, nitrocellulose lacquer and butyl acetate are added to the mixture thus obtained so that a suspension is prepared. This suspension is applied to the base 1 containing Ni as a major element by a spray method so that the applied suspension has a thickness of approximately 80 μm. After that, the carbonate is decomposed to oxide, in the same manner as in the prior art, and the oxide is partially reduced so that the electron-emissive layer 2 on the base 1 is activated.

Figure 1:
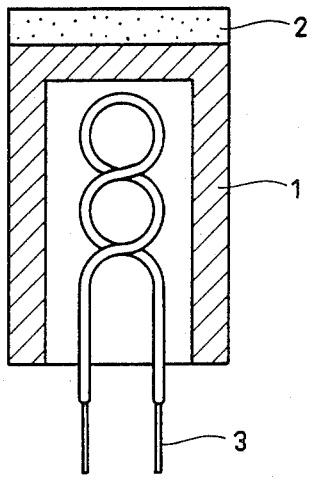
FIG. 1 is a schematic sectional view illustrating a cathode for an electron tube.
Figure 2A:
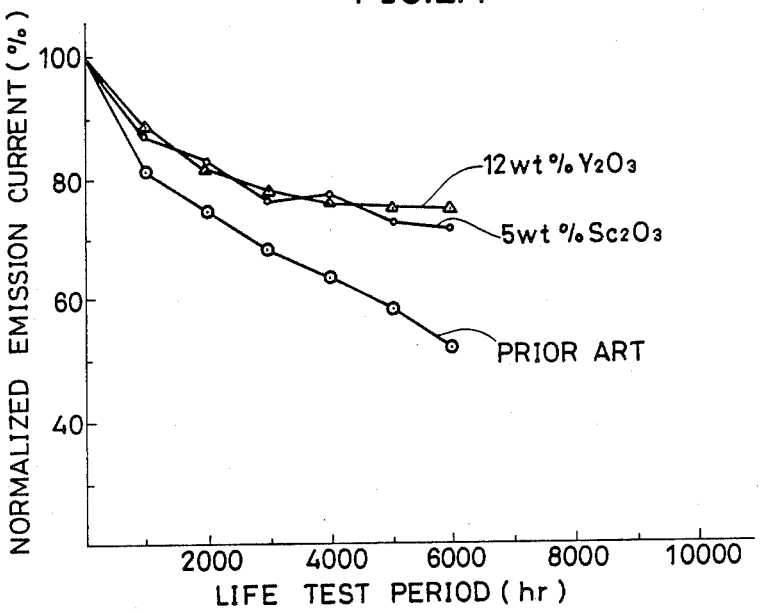
FIG. 2A is a graph showing the relation between the life test period and the emission current under the normal condition after the test in an embodiment of the present invention and FIG. 2B is a graph showing the relation between the current density during the life test and the emission current under the normal condition after the test.

In the above described manner, cathodes provided with electron-emissive layers 2 containing $Sc_2O_3$ or $Y_2O_3$ in various wt. % were prepared. Then, diode vacuum tubes using those cathodes were prepared and they were subjected to life tests using various constant current densities so that changes in the emission current under the normal condition after the tests were examined. FIG. 2A shows the emission current in a cathode containing $Sc_2O_3$ in 5 wt. %, a cathode containing $Y_2O_3$ in 12 wt. % and a conventional cathode not containing any rare earth metal oxide, respectively, after the life test using a constant current density (2.05 A/cm$^2$) 3.1 times as large as the operation current density 0.66 A/cm$^2$ of a conventional cathode for CRT under the normal condition. The vertical axis in FIG. 2A represents the ratio of the emission current under the normal condition after the life test to the initial emission current under the normal condition. With the cathodes according to this embodiment, an initial emission current of 1 to 2 A/cm$^2$ can be obtained under the normal condition at the operation temperature of 700° to 800° C. As is obvious from this figure, the cathodes containing rare earth metal oxides have characteristics that the emission current after the life test with the high current density is less lowered as compared with the conventional cathode.

Figure 2B:
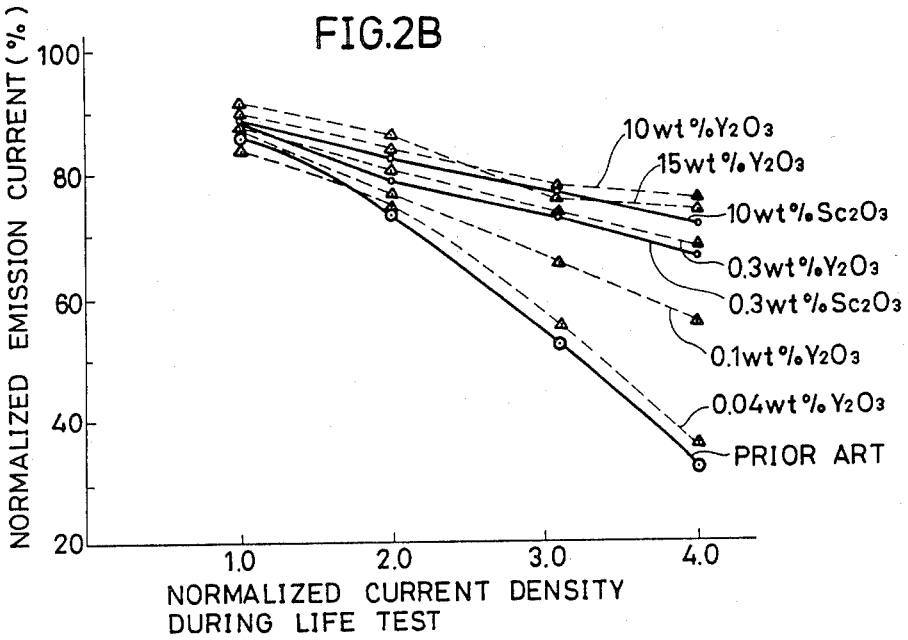

FIG. 2B shows the ratio of the emission current under the normal condition after the life tests of 6000 hr to the initial emission current under the normal condition, as the result of the life tests conducted using a constant current density of 0.66 A/cm$^2$ and constant current densities of twice, 3.1 times and 4 times that value with respect to the cathodes provided with electron-emissive layers 2 containing $Sc_2O_3$ or $Y_2O_3$ in various wt. %. As can be seen from FIG. 2B, $Sc_2O_3$ or $Y_2O_3$ in amounts of more than 0.1 wt. % has an effect in preventing lowering of the emission current under the normal condition after the life test with the high current density. Though not shown in FIG. 2B, this effect was found up to the concentration of 20 wt. % of $Sc_2O_3$ or $Y_2O_3$. However, if the concentration of $Sc_2O_3$ or $Y_2O_3$ exceeds 20 wt. %, it becomes difficult to obtain a stable emission current unless a further aging process for a long period is applied after the manufacturing process. Therefore, the content of a rare earth metal oxide in the electron-emissive layer 2 is preferably in the range from 0.1 to 20 wt. % and more preferably in the range from 0.3 to 15 wt. %.

It is believed that the good electron emission characteristics of the cathodes according to the above described embodiment are obtained because the following reasons.

(1) The powder of $Sc_2O_3$ or $Y_2O_3$ mixed in the electron-emissive layer 2 reacts with the alkaline earth metal oxide, e.g., BaO and forms a composite oxide $Ba_3Sc_4O_9$ or $Ba_3Y_4O_9$. This composite oxide dispersed in the electron-emissive layer 2 tends to thermally decompose and produce free Ba at the operation temperature of the cathode. Although the formation of free Ba in the conventional cathode completely depends on the reducing process caused by a small amount of the reducing element Si or Mg in the base 1, the thermal decomposition of the composite oxide produces additional free Ba in this embodiment. Therefore, there exists a sufficient amount of free Ba in the cathode of this embodiment, even though the reducing process is limited by the intermediate layer as described previously.

(2) Some of the composite oxide also sets the Sc element or Y element free and produces metallic Sc or Y dispersed in the electron-emissive layer 2. This metallic Sc or Y increases electric conductivity of the electron-emissive layer 2, compensating for the resistance of the intermediate layer.

Figure 3A:
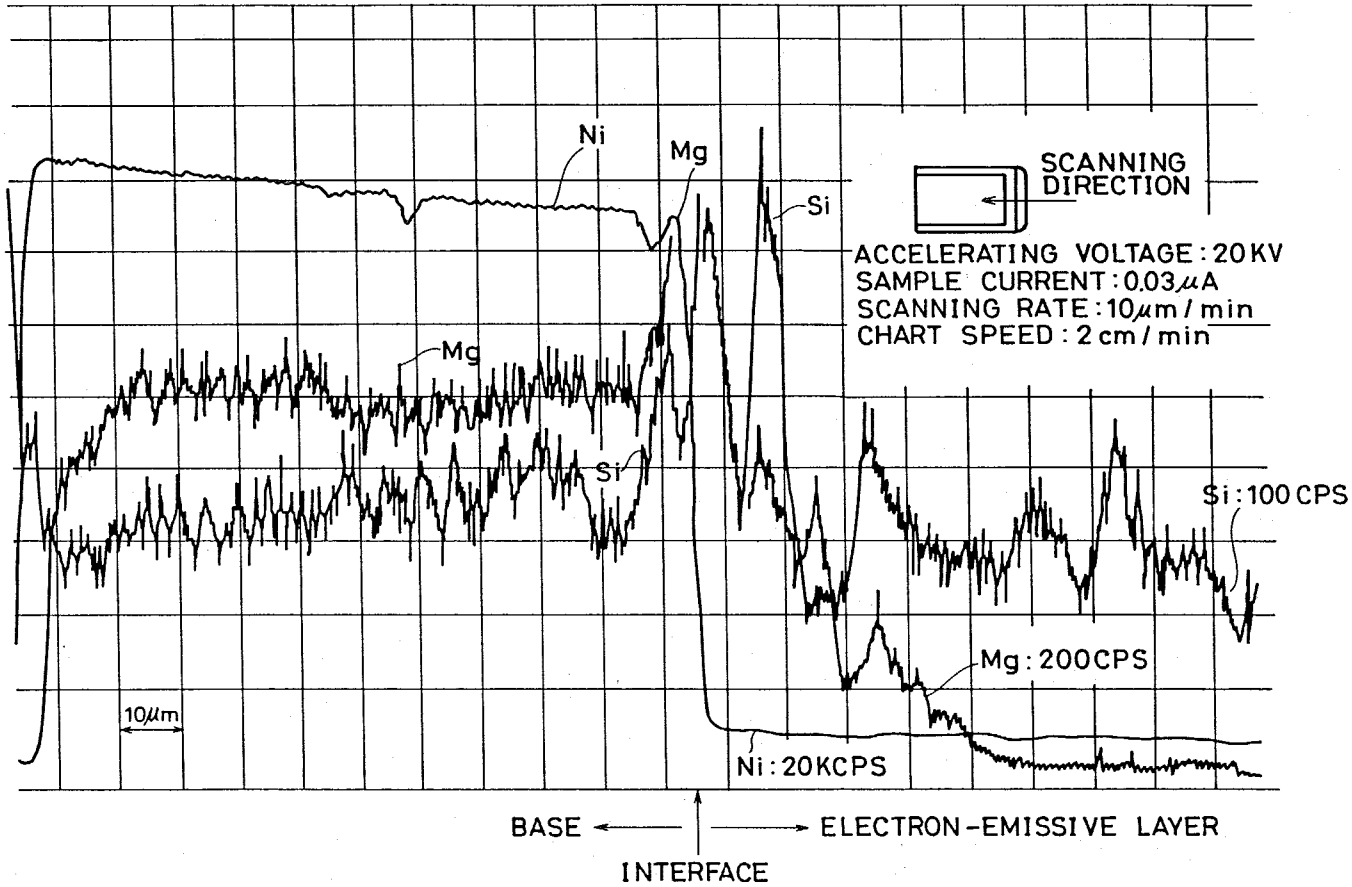
FIGS. 3A and 3B are graphs showing results of chemical analyses by EPMA as to the interface region between the base and the electron-emissive layer after a long period of the life test in a conventional cathode and a cathode of the above stated embodiment, respectively.

In order to precisely examine the effect of the rare earth metal oxide contained in the electron-emissive layer 2, the cathode containing $Sc_2O_3$ an amount of in 5 wt. % and the conventional cathode after the life test of 6000 hr as shown in FIG. 2A were analyzed by using an electron probe micro analyzer (EPMA). FIG. 3A shows the results of the analysis in the interface region between the base 1 and the electron-emissive layer 2 of the conventional cathode. As is obvious from FIG. 3A, the reducing agents Si and Mg are segregated in the vicinity of the interface between the base 1 containing Ni as a major element and the electron-emissive layer 2. In the segregated state, a peak of Si and that of Mg are observed at a position of approximately 5 μm from the interface toward the base 1 and at a position of approximately 3 to 5 μm from the interface toward the electron-emissive layer 2, respectively. The largest peak of Si is observed at a position of approximately 13 μm from the interface toward the electron-emissive layer 2. Though not shown, peaks of Ba were observed at the same positions as the peak positions of Mg and Si in the electron-emissive layer. Since these peak positions of Si, Mg and Ba are almost coincident to the peak positions of oxygen, these elements are considered to exist as oxides or composite oxides.

More specifically, in a conventional cathode, layers of $SiO_2$, MgO and a composite oxide thereof are formed in the grain boundary in the base 1 near the interface during the life test with the high current density and layers of oxides BaO, MgO and $SiO_2$ and composite oxides thereof are formed in the electron-emissive layer 2 at locations near the interface. The layer of $SiO_2$.MgO and the layer of BaO.$SiO_2$ suppress diffusion of the reducing agents Si and Mg from the base 1 into the electron-emissive layer 2 and also suppress flow of electric current because of high resistance of those layers.

Figure 3B:
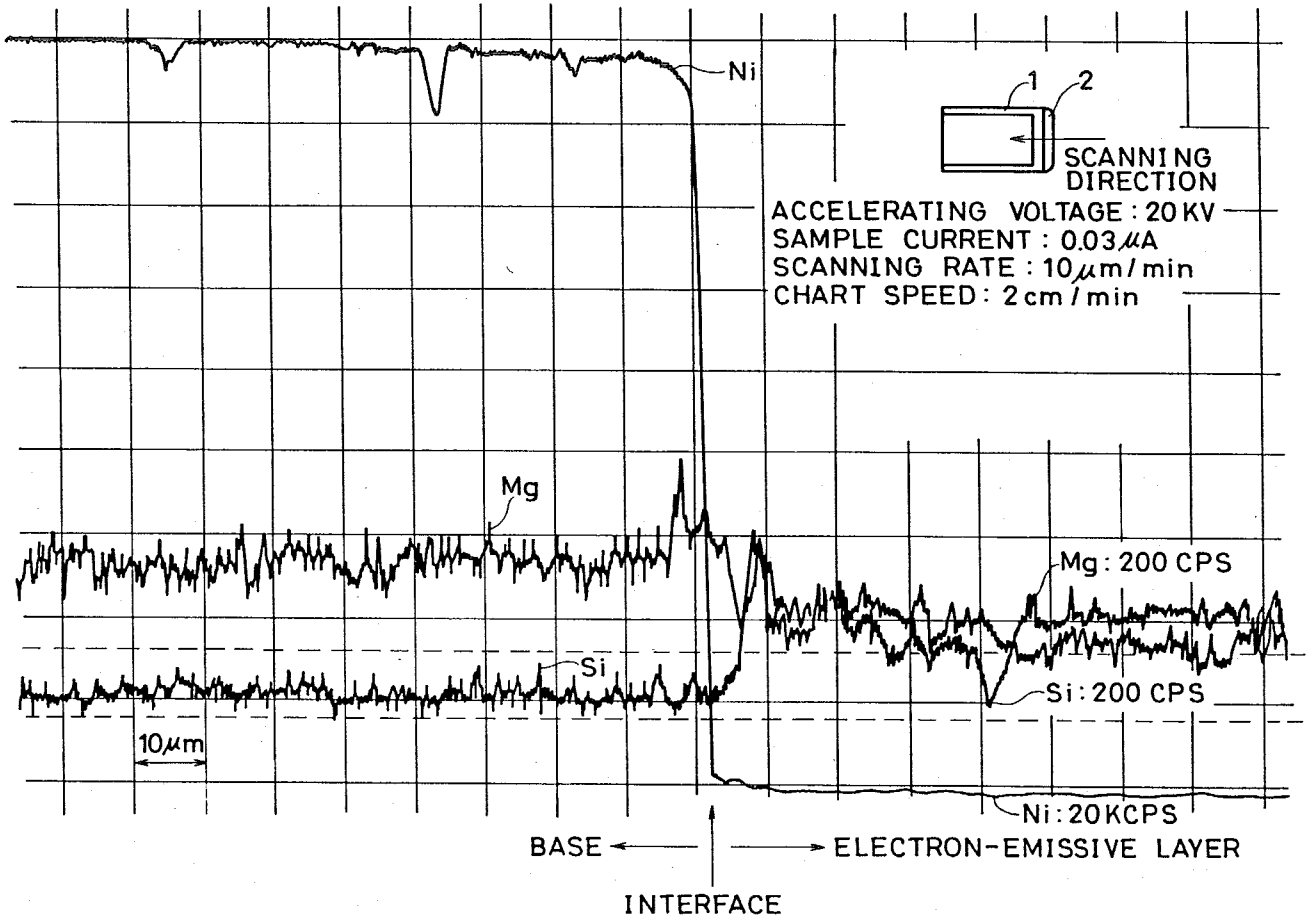

On the other side, FIG. 3B shows results of the analysis of the cathode containing $Sc_2O_3$ according to this embodiment. Referring to FIG. 3B, the elements Si and Mg are dispersed uniformly in each of the base region and the electron-emissive region and such high peaks as shown in FIG. 3A are not observed.

This is supposed to be because the rare earth metal oxide prevents oxidation of the interfacial layer of the base 1 when the alkaline earth metal carbonate is decomposed to oxide or when dissociation reaction occurs in BaO or the like during the operation of the cathode.

For example, when $Sc_2O_3$ is selected as a rare earth metal oxide, reaction as indicated below is considered to occur in the interface region.

$$BaCO_3 \rightarrow BaO + CO_2 \quad (3)$$

$$Ni + \tfrac{1}{2}CO_2 \rightarrow NiO + \tfrac{1}{2}C \quad (4)$$

$$Sc_2O_3 + 3CO_2 \rightarrow Sc_2(CO_3)_3 \quad (5)$$

$$BaO \rightarrow Ba + O \quad (6)$$

$$Ni + O \rightarrow NiO \quad (7)$$

$$3Ba + 3O + Sc_2O_3 \rightarrow Ba_3Sc_4O_9 \quad (8)$$

More specifically stated, when $Sc_2O_3$ is not contained in the electron-emissive layer, $BaCO_3$ in that layer reacts with Ni in the base according to the formulas (3), (4), (6) and (7) whereby an oxide layer of NiO is formed in the interfacial layer of the base 1. On the other hand, if $Sc_2O_3$ is contained in the electron-emissive layer 1, $Sc_2O_3$ reacts preferentially with $BaCO_3$ or BaO according to the formulas (3), (5), (6) and (8) and accordingly there is not formed any oxide layer of NiO on the surface of the base 1.

Since the base 1 contains Si and Mg as reducing agents, layers of $SiO_2$ and MgO are formed in the vicinity of the interface if $Sc_2O_3$ is not contained in the electron-emissive layer. Accordingly, diffusion of the reducing agents Si and Mg into the electron-emissive layer 2 is limited by the oxide layers of $SiO_2$ and MgO and the reactions represented by the formulas (1) and (2) occur only in the vicinity of those oxide layers. As a result, oxide layers of $SiO_2$ and MgO are formed preferentially in the vicinity of the interface particularly during the life test with the high current density and diffusion of Si and Mg into the electron-emissive laye is further limited, and thus the emission current under the normal condition is extremely lowered.

In a cathode according to this embodiment, the rare earth metal oxide in the electron-emissive layer 2 suppress oxidation of Ni, Si and Mg to prevent formation of an oxide film in the interface region and in consequence the reducing elements Si and Mg easily diffuse deep into the electron-emissive layer 2. Accordingly, the reactions represented by the formulas (1) and (2) occur more homogeneously within the electron-emissive layer 2.

In addition, since the rare earth metal oxide suitably controls diffusion rate of the reducing elements in the electron-emissive layer, the emission characteristics of the cathode can be maintained stably and in good condition even after the life test with the high current density for a long period.

However, a cathode containing a rare earth metal oxide of less than 0.1 wt. % can not achieve satisfactorily the effect of suppressing formation of the oxide layers of $SiO_2$ and MgO in the vicinity of the interface and as a result the emission characteristics can not be improved sufficiently. To the contrary, a rare earth metal oxide of more than 20 wt. % suppresses excessively diffusion of the reducing elements in the electron-emissive layer 2 and the emission characteristics can not be improved sufficiently either.

On the other hand, in a cathode containing a rare earth metal oxide of 0.2 to 20 wt. %, the rare earth metal dissolved into the base 1 was observed. In addition, separation of the electron-emissive layer 2 from the base 1 never occurred after the life test for 6000 hr (with a current density of 2.05 A/cm$^2$). As for the conventional cathodes, separation of the electron-emissive layer 2 was observed with frequency of 30%.

Although a cathode using $Sc_2O_3$ and/or $Y_2O_3$ as the rare earth metal oxide(s) was described in the above embodiment, the same effect can also be obtained if rare earth metal oxides containing La, Ce, Pr, Nd, Sm, Gd, Dy, Ho, Er, Tm, etc. are used. Such oxides as $Sc_2O_3$, $Y_2O_3$ and $Ce_2O_3$ are particularly preferred.

According to another embodiment of the present invention, rare earth metal oxide powder is subjected to a heat treatment in a reducing atmosphere before it is mixed with an alkaline earth metal oxide. This heat treatment may be performed in a gas containing hydrogen at a temperature of 800° C. or more, preferably 1000° C. or more, for a period of 10 minutes or more.

This heat treatment causes partial reduction of the rare earth metal oxide thereby to enhance the reactive property of the rare earth metal oxide.

Figure 4A:
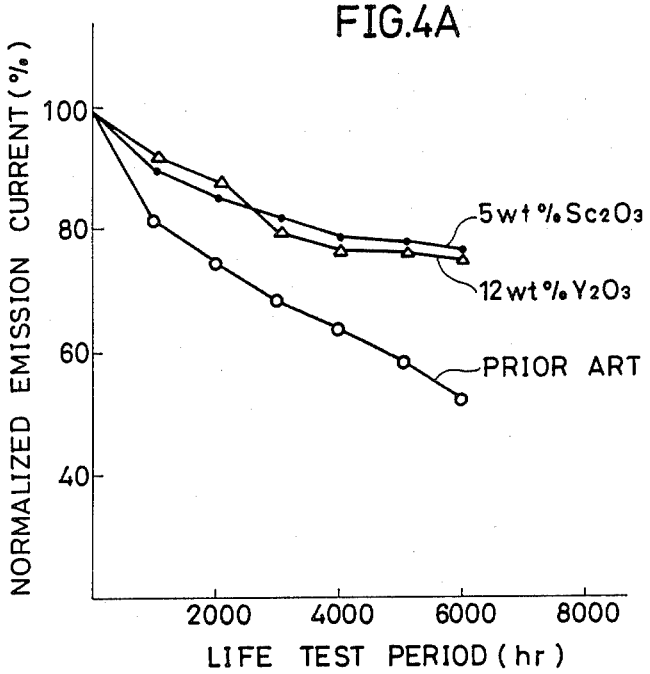
FIG. 4A is a graph showing the relation between the life test period and the emission current after the test in another embodiment of the present invention and FIG. 4B is a graph showing the relation between the current density during the life test and the emission current after the test.

FIG. 4A shows, in the same manner as in FIG. 2A, the emission current after the life test with 2.05 A/cm$^2$ with regard to cathodes according to this embodiment. The lowering of the emission current in FIG. 4A is suppressed a little further than that in FIG. 2A.

Figure 4B:
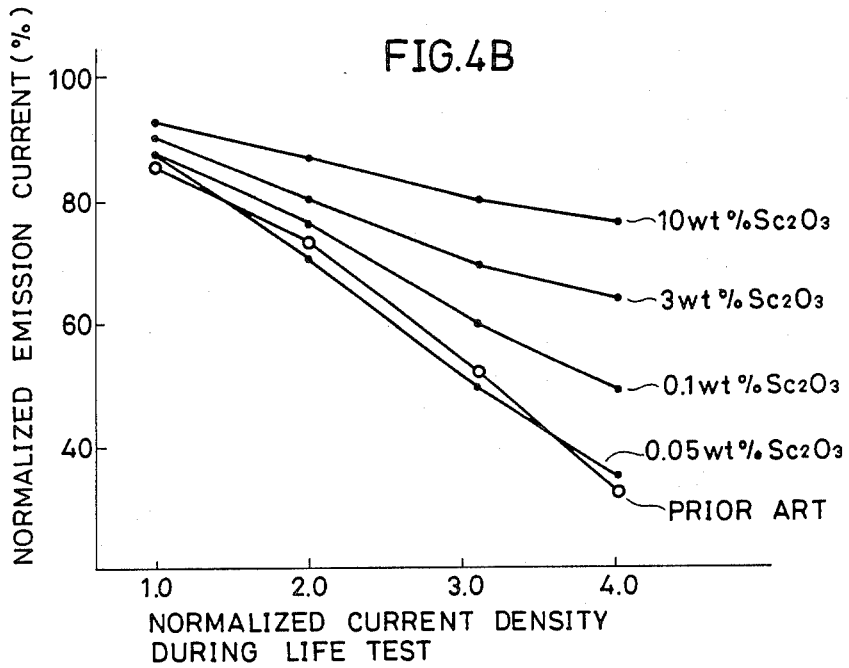

FIG. 4B shows, in the same manner as in FIG. 2B, the emission current of cathodes according to this embodiment after the life tests of 6000 hr using various high current densities. The decrease of the emission current in FIG. 4B is suppressed a little more than that in FIG. 2B.

Figure 5A:
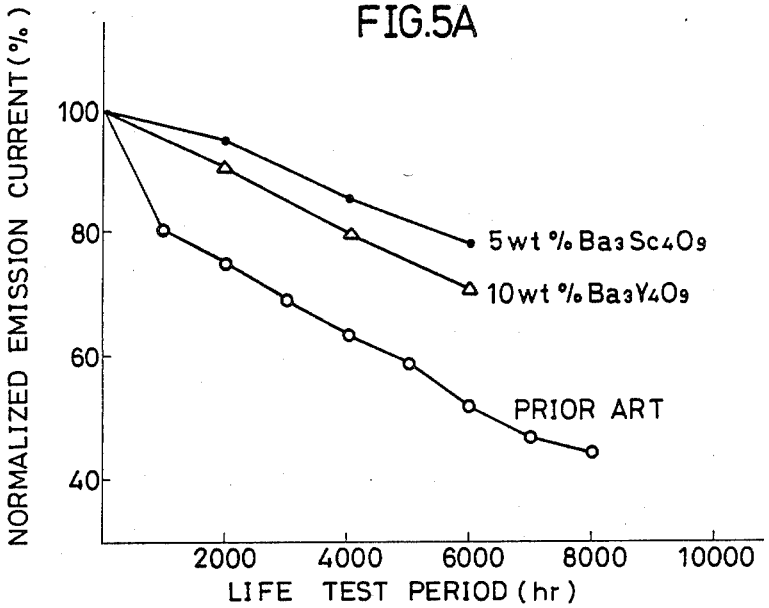
FIG. 5A is a graph showing the relation between the life test period and the emission current in a further embodiment of the present invention and FIG. 5B is a graph showing the relation between the current density during the life test and the emission current.

According to a further embodiment of the present invention, a rare earth metal oxide is contained in the electron-emissive layer in the form of a composite oxide of $Ba_3Sc_4O_9$ or $Ba_3Y_4O_9$. FIG. 5A shows, in the same manner as in FIG. 2A, the emission current after the life test with 2.05 A/cm$^2$ with regard to cathodes according to this embodiment.

Figure 5B:
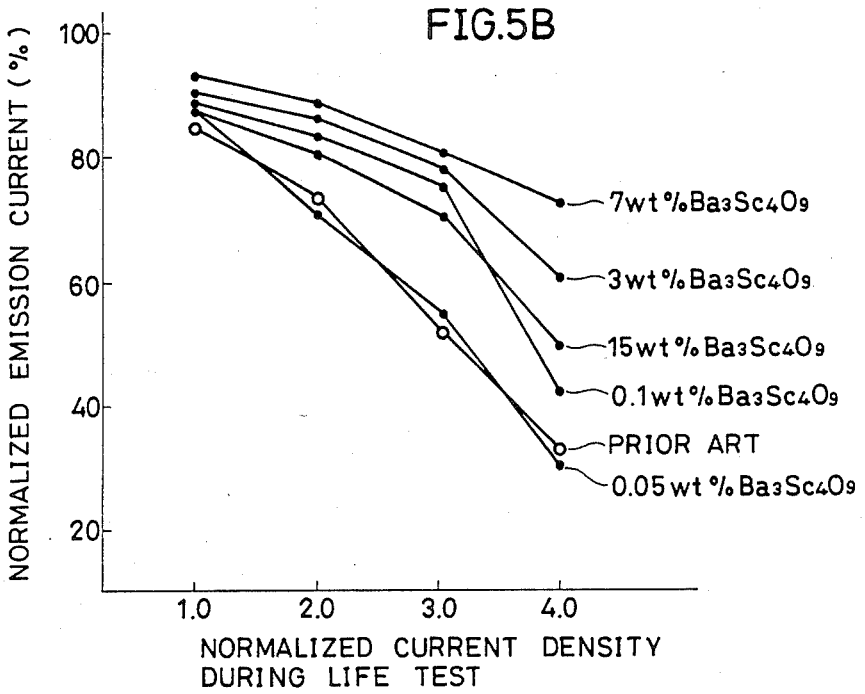

FIG. 5B shows, in the same manner as in FIG. 2B, the emission current after the life test with various high current densities with regard to cathodes according to this embodiment.

Although a cathode containing $Ba_3Sc_4O_9$ or $Ba_3Y_4O_9$ was shown in this embodiment, other composite oxides such as $BaSc_2O_4$, $BaY_2O_4$, $Sr_3Sc_4O_9$, $Ca_3Sc_4O_9$ and $Ba_3Ce_4O_9$ containing alkaline earth metals and rare earth metals can also be used effectively.

According to a still further embodiment of the present invention, the electron-emissive layer 2 contains not only a rare earth metal oxide of 0.1 to 20 wt. % but also powder of 10 wt. % or less comprising at least one of Ni and Co. Ni and/or Co powder serves to provide a better conductivity for the electron-emissive layer 2 and to improve the adhesive property of this layer 2 to the base.

Table I indicates the emission current under the normal condition as to cathodes according to this embodiment after the life test of 6000 hr using a high current density (2.6 A/cm$^2$) 4 times as large as 0.66 A/cm$^2$.

TABLE I

| Sample | Content in electron-emissive layer (wt. %) $Sc_2O_3$ | Ni | Normalized emission-current after life test (%) |
|---|---|---|---|
| 0 | — | — | 32 |
| 1 | 0.05 | 0.1 | 38 |
| 2 | 0.1 | 0.1 | 60 |
| 3 | 0.5 | 0.1 | 70 |
| 4 | 5 | 0.1 | 83 |
| 5 | 10 | 0.1 | 85 |
| 6 | 20 | 0.1 | 61 |
| 7 | 25 | 0.1 | 40 |
| 8 | 5 | 0.05 | 78 |
| 9 | 5 | 1 | 85 |
| 10 | 5 | 5 | 87 |
| 11 | 5 | 10 | 65 |
| 12 | 5 | 13 | 45 |

In this table, sample 0 is a conventional cathode in which the electron-emissive layer comprises a ternary alkaline earth metal oxide of (Ba, Sr, Ca) 0. Samples 1 through 12 contain $Sc_2O_3$ and Ni in addition to the ternary alkaline earth metal oxide. As is cloear from this table, there is less deterioration in the emission current after the life test with the high current density in the cathodes containing $Sc_2O_3$ and Ni as compared with the conventional cathode. Particularly, $Sc_2O_3$ of 0.1 to 20 wt. % and Ni of less than 10 wt. % are preferred for improvement of the emission characteristics of the cathode. If the content of Ni exceeds 10 wt. %, sintering occurs between the Ni powder and the alkaline earth metal oxide powder to cause unfavorable influence on the surface of the electron-emissive layer, resulting in deterioration of the electron emission characteristics.

Although the electron-emissive layer containing Ni was described in this embodiment, an electron-emissive layer containing Co can also be used effectively.

According to a still further embodiment of the present invention, the electron-emissive layer 2 contains not only scandium oxide of 0.1 to 20 wt. % but also a reducing metal of 1 wt. % or less. Table II shows, in the same manner as Table I, the emission current after the life test with the high current density as to cathodes containing Fe as a reducing element.

TABLE II

| Sample | Content in electron-emissive layer (wt. %) $Sc_2O_3$ | Fe | Normalized emission-current after life test (%) |
|---|---|---|---|
| 0 | — | — | 32 |
| 1 | 0.05 | 0.1 | 38 |
| 2 | 0.1 | 0.1 | 60 |
| 3 | 0.5 | 0.1 | 68 |
| 4 | 5 | 0.1 | 80 |
| 5 | 10 | 0.1 | 82 |
| 6 | 20 | 0.1 | 60 |
| 7 | 25 | 0.1 | 37 |
| 8 | 5 | 0.007 | 75 |
| 9 | 5 | 0.01 | 75 |
| 10 | 5 | 0.05 | 78 |
| 11 | 5 | 0.3 | 80 |
| 12 | 5 | 0.5 | 75 |
| 13 | 5 | 1.0 | 60 |
| 14 | 5 | 1.3 | 43 |

The reducing element Fe assists the rare earth metal oxide in suppressing formation of oxide layers of $SiO_2$ and MgO in the interfacial layer of the base 1. The content of Fe is preferablY 1 wt. % or less. It is exceeds 1 wt. %, the alkaline earth metal oxide is reduced excessively and Ba is produced in an excessive amount, causing the lifetime of the cathode to be decreased.

Although Fe was described as the reducing metal in this embodiment, such metals as Ti, Zr, Hf, V, Nb, Ta, Si Al, Cu, Zn, Cr, Mo and W may also be used.

Figure 6A:
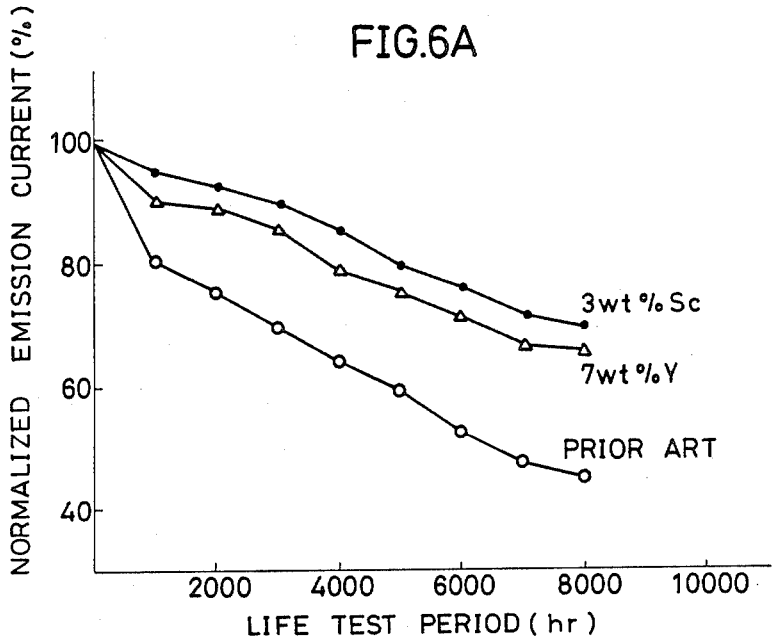
FIG. 6A is a graph showing the relation between the life test period and the emission current in a still further embodiment of the present invention and FIG. 6B is a graph showing the relation between the current density during the life test and the emission current.

According to a still further embodiment of the present invention, the electron-emissive layer 2 contains as a major element an alkaline earth metal oxide containing at least Ba and also contains a rare earth metal of 0.05 to 15 wt. %. FIG. 6A shows, in the same manner as in FIG. 2A, the emission current after the life test with the current density of 2.05 A/cm$^2$ as to cathodes according to this embodiment. As can be seen from this figure, lowering of the emission current in the cathodes of this embodiment is much suppressed as compared with the conventional cathode.

Figure 6B:
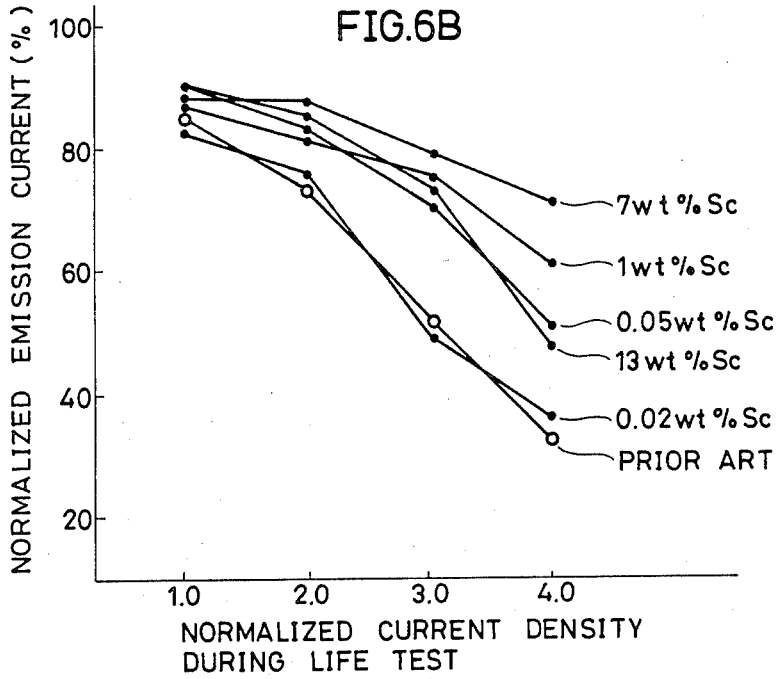

FIG. 6B shows, in the same manner as in FIG. 2B, the emission current after the life tests of 6000 hours with various high current densities as to cathodes according to this embodiment. As can be seen from this figure, a rare earth metal of more than 0.05 wt. % contributes effectively to an improvement of the emission characteristics. However, if the rare earth metal exceeds 15 wt. %, it becomes difficult to obtain a stable emission current unless aging for a long period is applied, and such procedure is not preferred from a practical point of view. Therefore, the content of the rare earth metal in the electron-emissive layer 2 is preferably in the range from 0.1 to 15 wt. % and more preferably in the range from 0.2 to 7 wt. %.

Although the cathode containing Sc or Y was shown in this embodiment, La, Ce, Pr, Nd, Sm, Gd, Dy, Ho, Er or Tm may also be used.

Figure 7:
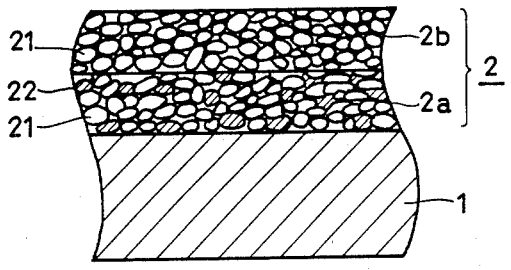
FIG. 7 is an enlarged fragmentary sectional view schematically illustrating a cathode according to a still further embodiment of the present invention.

FIG. 7 is an enlarged fragmentary sectional view schematically illustrating a cathode according to a still further embodiment of the present invention. In this embodiment, the electron-emissive layer 2 comprises a first layer 2a formed on the base 1 and a second layer 2b formed on the first layer 2a. The first layer 2a contains not only alkaline earth metal oxide powder 21 but also rare earth metal oxide powder 22 of 0.2 to 20 wt. % containing Sc. The-second layer 2b contains only alkaline earth metal oxide powder 21. Usually, each of the first and second layers 2a and 2b is formed to be approximately 40 μm in thickness. The cathode of this embodiment has a particularly stable initial electron-emission characteristic of 1 to 2 A/cm$^2$ under the normal condition at the operation temperature of 700° to 800° C.

Figure 8:
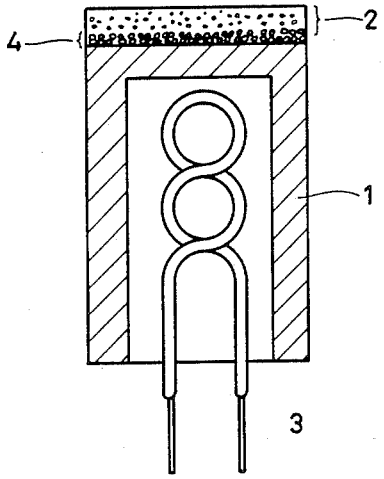
FIG. 8 is a sectional view illustrating a cathode according to a still further embodiment of the present invention.

FIG. 8 shows a cathode according to a still further embodiment of the present invention. In this embodiment, a sintered Ni powder layer 4 is formed on the surface of the base 1, and the electron-emissive layer 2 containing not only an alkaline earth metal oxide but also a rare earth metal oxide of 0.1 to 20 wt. % is formed on the sintered powder layer 4.

The sintered Ni powder layer is formed in the following manner. Ni metal powder having a grain size of 3 to 5 μm is mixed with nitrocellulose lacquer and butyl acetate so that a suspension is prepared. This suspension is applied to the base 1 by a spray method so that the applied suspension has a thickness of approximately 30 μm. Then, the applied suspension is subjected to a heat treatment in an atmosphere of hydrogen at 1000° C. for 10 minutes so that it is sintered.

The sintered Ni powder layer 4 is porous and thus a part of the electron-emissive layer 2 applied thereon penetrates the sintered layer 4 to be in direct contact with the base 1. Even if the above described intermediate layer of $SiO_2$, MgO or the like is formed in the region of contact with the base 1, lowering of the conductivity due to the formation of the intermediate layer can be prevented because a considerably large part of the electron-emissive layer 2 contacts the sintered layer 4.

The thickness of the sintered Ni powder layer 4 is preferably 10 to 50 μm. A sintered layer of less than 10 μm is not effective because the intermediate layer of oxide might be formed on the side of the electron-emissive layer, exceeding the sintered layer. On the contrary, if the thickness exceeds 50 μm, the alkaline earth metal oxide can not be sufficiently penetrated into the sintered layer 4 and thus does not sufficiently come in contact with the base 1 containing the reducing element and, as a result, activation of the electron-emissive layer 2 can not be made in a satisfactory manner.

Figure 9:
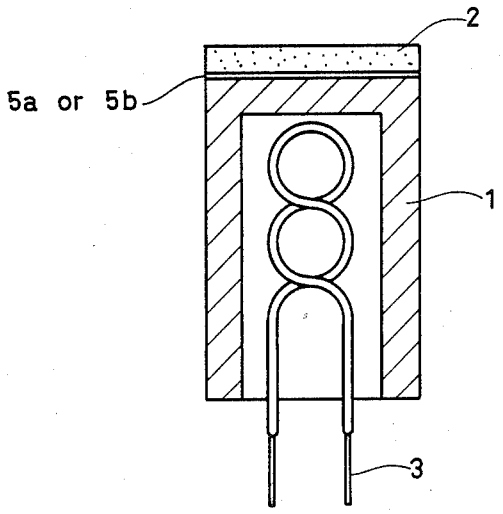
FIG. 9 is a sectional view illustrating a cathode according to a still further embodiment of the present invention.

FIG. 9 shows a cathode according to a still further embodiment of the present invention. In this embodiment, a rare earth metal oxide layer 5a or a rare earth metal layer 5b is provided between the base 1 and the electron-emissive layer 2 made of an alkaline earth metal oxide. The rare earth metal oxide layer 5a or the rare earth metal layer 5b is formed by an electron beam evaporation method or a sputtering method prior to formation of the electron-emissive layer 2.

In the above described cathode, the rare earth metal dissolves from the layer 5a or 5b into the base 1. Accordingly, even if oxygen produced by dissociation of BaO or other similar phenomenon is diffused into the base 1, segregation of $SiO_2$ and MgO in the interfacial region of the base 1 is suppressed because the rare earth metal dissolved in the base 1 reacts with the oxygen to form a rare earth metal oxide. In addition, the rare earth metal dissolved into the base 1 serves to strengthen the adhesion between the layer 5a or 5b and the base 1 and to prevent embrittlement of the base 1 containing Ni as a major element.

Figure 10:
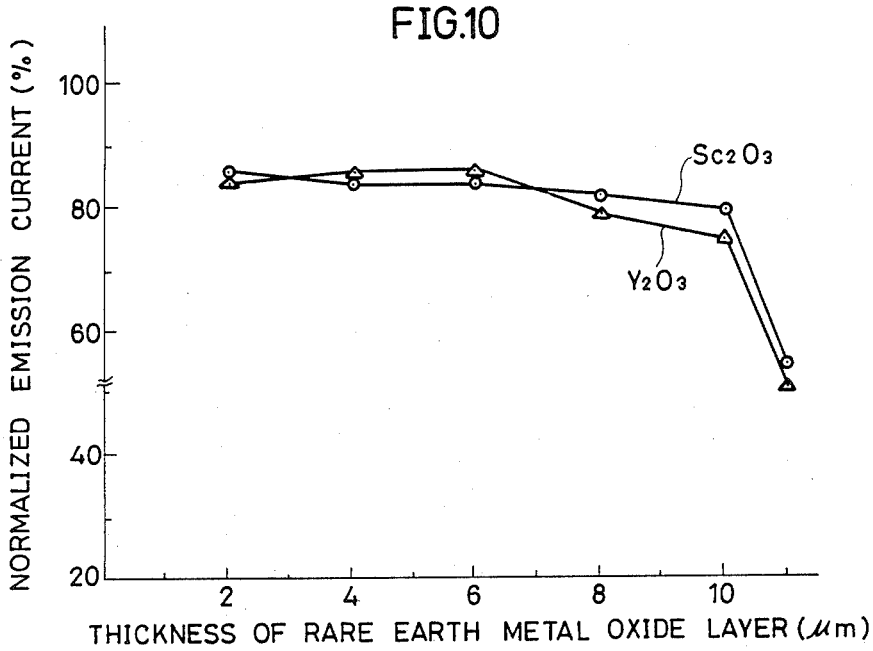
FIG. 10 is a graph showing the relation between the thickness of a rare earth metal oxide layer in a cathode of the embodiment in FIG. 9 and the emission current after the life test.

FIG. 10 shows the emission current after the life test of 6000 hr with the current density of 2.05 A/cm$^2$ with regard to cathodes provided with the rare earth metal oxide layer 5a of $Sc_2O_3$ or $Y_2O_3$ having various values of thickness. As is clear from this figure, the cathode having the rare earth metal oxide layer of less than 10 μm in thickness shows an extremely excellent characteristic in prevention of lowering of the emission current as compared with a conventional cathode. However, if the thickness of the rare earth metal oxide layer exceeds 10 μm, the reducing elements Si and Mg can not be diffused sufficiently from the base 1 into the electron-emissive layer 2 and separation of the rare earth metal oxide layer 5a from the base 1 may occur during the life test with the high current density.

Figure 11:
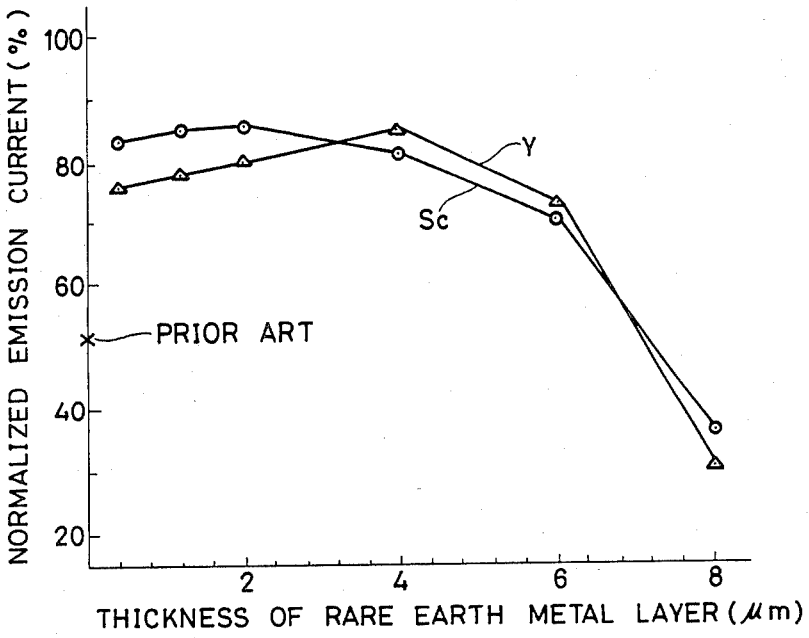
FIG. 11 is a graph showing the relation between the thickness of a rare earth metal layer in a cathode of the embodiment in FIG. 9 and the emission current after the life test.

FIG. 11 shows, in the same manner as FIG. 10, the emission current with regard to cathodes provided with the rare earth metal layer 5b containing Sa or Y having various values of thickness. As is clear from this figure, the cathode having the rare earth metal layer of less than 6 μm shows much less deterioration in the emission current as compared with a conventional cathode. However, if the thickness of the rare earth metal layer exceeds 6 μm, the reducing elements Si and Mg can not be diffused sufficiently from the base 1 into the electron-emissive layer 2, causing the emission current to be considerably decreased.

Although the oxide layer 5a or the metal layer 5b containing Sc or Y was described in the embodiment in FIG. 9, an oxide or a metal containing at least one of the metals La, Ce, Pr, Nd, Sm, Gd, Dy, Ho, Er and Tm may also be used.

In a cathode according to a still further embodiment of the present invention, a rare earth metal of 0.01 to 0.5 wt. % is contained in the base 1. An electron-emissive layer 2 made of an alkaline earth metal oxide containing at least Ba is formed directly on this base 1.

Figure 12:
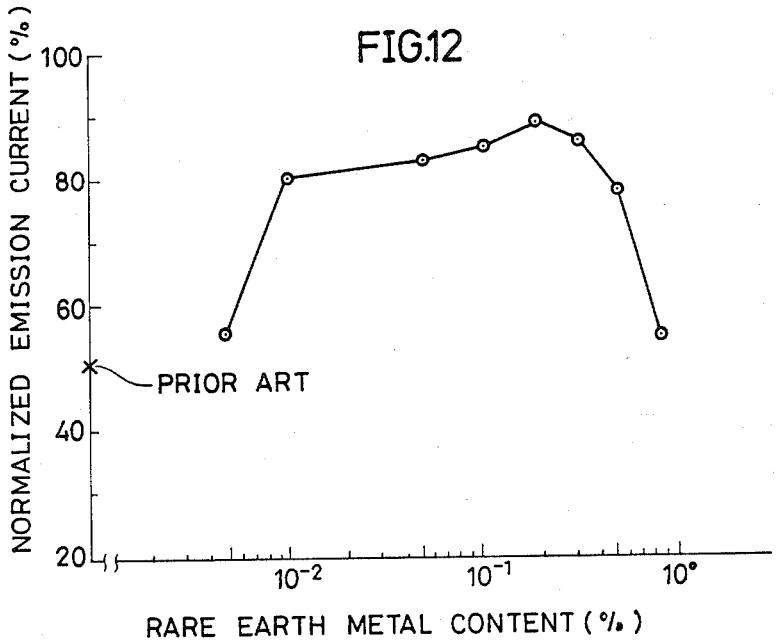
FIG. 12 is a graph showing the relation between the rare earth metal content in the base of a cathode and the emission current after the life test according to a still further embodiment of the present invention.

FIG. 12 shows the relation between the rare earth metal content of Sc and/or Y in the base of the cathode according to this embodiment and the emission current after the life test of 6000 hr with the current density of 2.05 A/cm$^2$ As is clear from this figure, the cathode having the base 1 containing rare earth metal of 0.01 to 0.5 wt. % shows a by far smaller degree of lowering of the emission current compared with a conventional cathode. If the rare earth metal concentration is less than 0.01 wt. %, it can not serve to sufficiently suppress formation of oxide layers of $SiO_2$ and MgO in the interfacial layer of the base 1.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An oxide-coated thermionic cathode for an electron tube, comprising:

a base comprising Ni as a major element, said base having a outer surface;

a reducing agent contained in said base;

only at least a portion of said outer surface of said base having coated thereon an electron-emisive substance comprising (a) an alkaline earth metal oxide as a principal component including barium oxide, and (b) 0.1 to 20 wt. % of at least one rare earth metal oxide selected from the group consisting of the oxides of Y, La, Ce, Pr, Nd, Sm, Gd, Sc, Dy, Ho, Er and Tm, and a heater for heating said layer.

2. An oxide-coated thermionic cathode according to claim 1, wherein said reducing agent contains at least one of silicon and magnesium.

3. A cathode in accordance with claim 1, wherein said rare earth metal oxide reacts to extend an operating lifetime of said cathode at an enhanced emission current density.

4. A cathode in accordance with claim 1, wherein said rare earth oxide reacts to inhibit formation of an intermediate layer between said base and said electron emissive layer.

5. A cathode in accordance with claim 1, wherein said rare earth metal oxide contains oxides of Y and Sc.

6. A cathode in accordance with claim 1, wherein said rare earth metal oxide is present in an amount in the range from 0.3 to 15 wt. %.

7. A cathode in accordance with claim 1, wherein said rare earth metal oxide has been subjected to a heat treatment at a high temperature in a reducing atmosphere before said rare earth metal oxide is mixed with said alkaline earth metal oxide.

8. A cathode in accordance with claim 7, wherein said high-temperature heat treatment is applied in a gas containing hydrogen at 800° C. or higher for 10 minutes or more.

9. A cathode in accordance with claim 1, wherein said rare earth metal oxide is present in the form of a composite oxide containing alkaline earth metal oxide.

10. a cathode in accordance with claim 9, wherein said composite oxide at least one of $Ba_3Sc_4O_9$, $Ba_3Y_4O_9$, $BaSc_2O_4$, $BaY_2O_4$, $Sr_3Sc_4O_9$, $Ca_3Sc_4O_9$ and $Ba_3Ce_4O_9$.

11. A cathode in accordance with claim 1, wherein said layer of the electron-emissive substance further contains powder in an amount of less than 10 wt. % and formed of at least one of Ni and Co.

12. A cathode in accordance with claim 1, wherein said layer of the electron-emissive substance further contains reducing metal in an amount of less than 1 wt. %.

13. A cathode in accordance with claim 12, wherein said reducing metal comprises at least one of Fe, Zr, Hf, V, Nb, Ta, Si, Al, Cu, Zn, Cr, Mo and W.

14. A cathode in accordance with claim 1, further including a second layer of an electron-emissive substance comprising alkaline earth metal oxide containing at least Ba coated on said first layer of the electron-emissive substance.

15. A cathode in accordance with claim 1, further including a sintered surface layer of Ni powder of 10 to 50 μm in thickness between said base and said layer of the electron-emissive substance.

16. An oxide-coated thermionic cathode for an electron tube, comprising;

a base comprising Ni as a major element, said base having an outer surface;

reducing agent contained in said base;

only at least a portion of said outer surface of said base having coated thereon an electron-emissive substance comprising (a) an alkaline earth metal oxide as a principal component including a barium oxide, and (b) 0.05 to 15 wt. % of at least one rare earth metal selected form the group consisting of the oxides of Y, La, Ce, Pr, Nd, Sm, Gd, Sc, Dy, Ho, Er and Tm, and a heater for heating said layer.

17. A cathode in accordance with claim 16 wherein said rare earth metal is present in an amount in the range from 0.2 to 7 wt. %.

18. A cathode in accordance with claim 17, wherein said layer of the electorn-emissive substance further contains reducing metal in an am ount of less than 1 wt. %.

19. A cathode in accordance with claim 18, wherein said reducing metal comprises at leat one of Fe, Zr, Hf, V, Nb, Ta, Si, Al, Cu, Zn, Cr, Mo and W.

20. A cathode in accordance with claim 17, further including a second layer of an electron-emissive substance containing alkaline earth metal oxide containing at leat Ba on said first layer of the electron-emissive substance.

21. A cathode in accordance with claim 17, further including a sintered surface layer of Ni powder of 10 to 50 μm in thickness between said base and said layer of the electron-emissive substance.

22. A cathode in accordance with claim 1, wherein said layer of the electron-emissive substance further contains powder in an amount of less than 10 wt. % formed of at least one of Ni and Co.

23. An oxide-coated cathode for an electron tube, comprising:

a base comprising Ni as a major element and a reducing agent, said base having an outer surface;

a rare earth metal oxide layer of less than 10 μm in thickness coated on at least a portion of said outer surface of said base, said rare earth metal oxide selected form the group consisting of at least one of the oxides of Sc, Y, La, Ce, Pr, Nd, Sm, Gd, Dy, Ho, Er and Tm, and a layer of an electron-emissive substance formed on said rare earth metal oxide layer and comprising alkaline earth metal oxide containing at leat Ba.

24. An oxide-coated cathode for an electron tube, comprising:

a base comprising Ni as a major element and a reducing agent, said base having an outer surface;

a rare earth metal layer of less than 6 μm in thickness coated on at least a portion of said outer surface of said base, said rare earth metal being selected from the group consisting of at least one of the oxides of Sc, Y, La, Ce, Pr, Nd, Sm, Gd, Dy, Ho, Er and Tm, and a layer of an electron-emissive substance formed on said rare earth metal layer and comprising alkaline earth metal oxide containing at least Ba.

25. An oxide-coated thermionic cathode for an electron tube, comprising:

a base containing Ni and a reducing agent, said base having an outer surface; and a layer of an electron-emissive substance coated on at least a portion of said outer srface of said base, said electron-emissive layer comprising a mixture of a powder of a rare earth metal oxide containing at least one of the oxides of Y, La, Ce, Pr, Nd, Sm, Gd, Sc, Dy, Ho, Er and Tm and an alkaline earth metal carbonate powder, said mixture being applied as a suspension containing said rare earth metal oxide powder and said alkaline earth metal carbonate powder to form said electron-emissive substance.

26. A cathode in accordance with claim 25, wherein said rare earth metal oxide is subjected to a heat treatment before said rare earth metal oxide is added to the suspension.

27. In an oxide-coated thermionic cathode for an electron tube, wherein a layer of an electron-emissive substance comprising an oxide of an alkaline earth metal including Ba is formed on the surface of a base comprising Ni and at least one reducing agent, and wherein free Ba is produced by reduction of said alkaline earth metal oxide by said at least one reducing agent, and wherein an interface layer containing an oxide of said at least one reducing agent is formed betwee said base and said electron-emissive layer as a result of partial reduction of said alkaline earth metal oxide layer which reduces an electron-emission characteristic of said cathode by limiting production of free Ba in said cathode: the improved cathode wherein an electron-emission characteristic of said cathode is enhanced by including in said layer a rare earth metal oxide containing at least one of the oxides of Y, La, Ce, Pr, Nd, Sm, Gd, Sc, Dy, Ho, Er and Tm in admixture with said alkaline earth metal oxide.

28. The cathode of claim 27, wherein said electron-emission characteristic of said cathode is cathode current density.

29. The cathode of claim 27, wherein said electron-emission characteristic of said cathode is cathode lifetime.

30. In an oxide-coated cathode for an electron tube comprising a base having a outer surface and comprising nickel as a major element, a reducing agent contained in said base, wherein only at least a portion of said outer surface of said base has coated thereon an electron emissive substance including an alkaline earth metal oxide as a principal component including barium oxide, free barium being produced by reduction of said alkaline earth metal oxide by said at least one reducing agent and wherein an interface layer containing an oxide of said at least one reducing agent between said base and said electron-emissive layer formed as a result of partial reduction of said alkaline earth metal oxide layer reduces an electron-emission characteristc of said cathode by limiting production of free barium in said cathode;

the improvement for extending a lifetime of said cathode at an enhanced current density operation thereof by preventing or inhibiting formation of said interface layer, comprising 0.1 to 20 wt. % of at least one rare earth metal oxide selected from the group consisting of the oxides of Y, La, Ce, Pr, Nd, Sm, Gd, Sc, Dy, Ho, Br and Tm, contained in admixture with said alkaline earth metal oxide in said electron emissive substance.

* * * * *

UNITED STATES PATENT AND TRADEMARK OFFICE

CERTIFICATE OF CORRECTION

PATENT NO. : 4,797,593

DATED : January 10, 1989

INVENTOR(S) : Masato SAITO et al.

It is certified that error appears in the above-identified patent and that said Letters Patent is hereby corrected as shown below:

On the title page, under [30] Foreign Application Priority Data, the 9th listed Japanese patent application should correctly read:

Jan. 18, 1986 [JP] Japan ..... 61-8366

Signed and Sealed this

Twenty-sixth Day of September, 1989

*Attest:*

DONALD J. QUIGG

*Attesting Officer*

*Commissioner of Patents and Trademarks*